United States Patent [19]

Svetlik

[11] Patent Number: 4,509,590

[45] Date of Patent: Apr. 9, 1985

[54] HEAT TRANSFER DEVICE AND METHOD OF MANUFACTURE

[75] Inventor: Harvey E. Svetlik, Dallas, Tex.

[73] Assignee: Phillips Petroleum Company, Bartlesville, Okla.

[21] Appl. No.: 341,719

[22] Filed: Jan. 22, 1982

[51] Int. Cl.[3] ..... F28D 15/00

[52] U.S. Cl. ..... 165/104.27; 29/157.3 H; 165/104.32; 165/DIG. 24

[58] Field of Search ..... 165/10, 104.27, 104.32, 165/DIG. 24; 29/157.3 R, 157.3 H

[56] References Cited

U.S. PATENT DOCUMENTS 4,033,130 7/1977 Hermans ..... 165/10

4,299,274 11/1981 Campbell ..... 165/10

*Primary Examiner*—Albert W. Davis, Jr.

*Attorney, Agent, or Firm*—C. F. Steininger

[57] ABSTRACT

In order to prevent collapse and stress cracking of heat transfer devices, such as those devices utilized in solar energy systems, a container, particularly one made of plastic, is partially filled with a solid or liquid heat transfer medium which evaporates and condenses over the working temperature range of the device, in an amount sufficient to leave a void space in the device at the highest temperature to which the device is subjected, an inert, solidifiable or liquifiable pressurizing material, such as solid carbon dioxide, which undergoes phase transition to a gaseous state at a temperature at least as high as the lowest temperature to which the device is subjected, in an amount sufficient to create a positive pressure within the void space at the lowest temperature to which the device is subjected, is added and the container is sealed to produce a gas and vapor impervious device. A heat transfer device manufactured in this manner is also disclosed.

18 Claims, 4 Drawing Figures

HEAT TRANSFER DEVICE AND METHOD OF MANUFACTURE

The present invention relates to a heat transfer device and a method of manufacturing the same. More specifically, the present invention relates to a heat transfer device of the heat pipe type and a method of manufacturing the same.

DESCRIPTION OF THE PRIOR ART

There are a number of structures capable of transferring a large amount of heat with a small temperature differential. These devices utilize the latent heat of a material which undergoes a phase transition over the working temperature range of the device. Such heat transfer devices are commonly referred to as heat pipes, irrespective of their configuration. In a heat pipe, a working fluid or heat transfer medium, which undergoes phase transition at the working temperature of the device, is sealed in a container, usually an elongated pipe-type device. A small temperature increase at one end, or the heat source of the device, evaporates at least a portion of the heat transfer medium which then passes to the opposite end of the device where heat is extracted and the heat transfer material condenses. This is generally referred to as the heat sink end of the device. The condensate then returns to the opposite end, or the heat source, by gravity or more frequently, by capillary effects. This capillary action can be attained in any number of known ways. For example, the inner wall of the heat pipe can be lined with a capillary structure consisting of layers of gauze or various types of wicks, a plurality of capillary-type channels formed in the inner surface of the pipe, etc. can be utilized. The heat transfer medium is usually one of a wide variety of materials of either solid or liquid nature which evaporates and condenses over the working range of the device. Examples of such materials are sodium, water-methanol mixtures, acetone, and relatively recent and highly effective material, calcium chloride hexahydrate. Heat pipe structures have been found particularly useful in solar energy applications because of their ability to transfer a large amount of heat from the small temperature increase created by the sun's rays.

The tube, or pipe itself, may be made of any number of materials, but in most cases it is impervious to the ingress or egress of gas and particularly the egress of the vapor phase heat transfer medium and the ingress of air from the atmosphere. As previously indicated, the heat transfer medium is sealed within the tube or pipe with a vapor space therein to permit evaporation of the heat transfer medium. Among the major difficulties in the manufacture of heat pipes is the sealing of the pipe after the heat transfer medium has been disposed therein. The difficulty is that the seal must also be gas impervious. A wide variety of techniques have heretofore been proposed to effect such sealing, for example, the closing of a cock which often results in gas leakage into or out of the device, and melting, soldering or welding. These latter techniques, of course, increase the temperature and, in many cases, evaporates a portion of the heat transfer medium. Accordingly, when the seal is completed, a vacuum wll develop in the void space in a tube. As will be pointed hereinafter, such evacuation, which is sometimes deliberately done, creates its own special problems. In order to mitigate the above-mentioned drawbacks of melting, soldering or welding, resort has been had to electron beam welding. However, such a technique is time consuming, expensive and also requires expensive equipment.

While most heat pipes or tubes have been manufactured from metals, it has recently been discovered that synthetic resins, particularly polyethylene and polypropylene can be utilized to produce heat pipes. While evacuation of the void space in a heat pipe made from metal will normally not be affected by the creation of a vacuum in the heat pipe, there are instances in which the walls of the pipe or tube are so thin that the differential pressure between the vacuum in the pipe and the atmospheric pressure without the pipe causes problems. It has been found also that where heat pipes are made of synthetic resins, such as polyethylene or polypropylene, the creation of a vacuum in the void space of the heat pipe causes flexural fatigue and consequent damage and leakage of gases and vapors into or out of the pipe. Consequently, it is the general practice to pressurize the void space in heat pipes made from synthetic resins. Such pressurization, after filling and sealing, requires specialized equipment, pressurization parts in the heat pipe and, again, the associated problems of closing the pressurizing opening with plugs, glues, seals, etc.

It is therefore an object of the present invention to overcome the above and other shortcomings of the prior art. Another object of the present invention is to provide an improved heat transfer device and method of manufacturing the same. A further object of the present invention is to provide an improved heat pipe type heat transfer device and method of manufacturing the same. Another further object of the present invention is to provide an improved heat pipe type heat transfer device and a method of pressurizing the same. A still further object of the present invention is to provide an improved heat pipe type heat transfer device, wherein the pipe is made of a material subject to flexural fatigue due to differences of internal and external pressure, in which such flexural fatigue is eliminated. Yet another object of the present invention is to provide heat pipe type heat transfer device wherein the heat pipe is simultaneously sealed and pressurized in a simple and expedient manner. These, and other objects of the present invention will be apparent from the following description.

SUMMARY OF THE INVENTION

In accordance with the present invention, an improved heat transfer device is provided in which a gas impervious container is partially filled with a major volume of a heat transfer medium, which undergoes phase transition within the working temperature range of the device, a minor amount of a pressurizing material, which undergoes phase transition to a gaseous state at a temperature at least as high as about the lowest temperature to which the device is subjected, is added to the container in an amount sufficient to create a pressure in the void space above the highest pressure to which the outside of the container is subjected and, thereafter, the container is sealed.

DESCRIPTION OF THE PREFERRED EMBODIMENTS

Figures 1, 2, 3, 4:
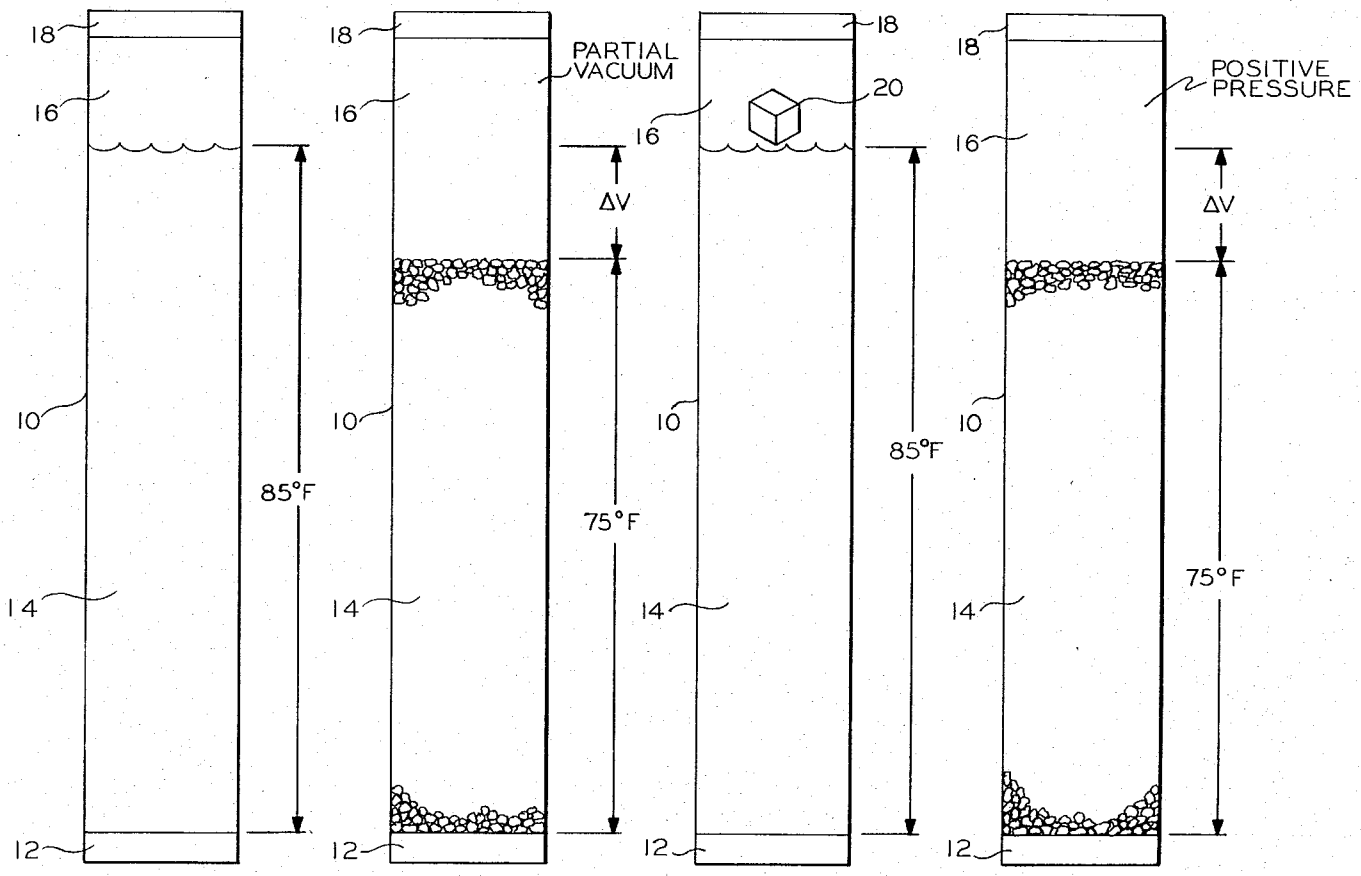
FIG. 2 PRIOR ART
FIG. 1 PRIOR ART
FIG. 1 of the drawings schematically shows a conventional heat pipe at the time of sealing the same.
FIG. 2 of the drawings shows a conventional heat pipe after the filling and sealing thereof.
FIG. 3 of the drawings shows a heat pipe in accordance with the present invention at the time of the sealing thereof.
FIG. 4 shows a heat pipe in accordance with the present invention after the filling and sealing thereof.

The preferred embodiment of the present invention will be described in connection with a heat pipe particularly useful in solar energy devices. It is to be understood, however, that while specific materials, techniques and uses are described herein, various modifications, equivalents and uses will be apparent to one skilled in the art and the invention is not confined to the preferred embodiment described.

Referring now to the drawings, FIG. 1 illustrates schematically a conventional heat pipe at the time of filling and sealing the same. In accordance with FIG. 1, the heat pipe comprises a pipe or tube 10. Pipe 10 may be constructed of any suitable material but is preferably a synthetic resin and still more preferably a polypropylene or polyethylene tube of the character utilized in the manufacture of high pressure gas transmission lines and other fluid transport lines. Pipe 10 is gas impervious and therefore, once sealed, is impervious to the ingress or egress of any gas or vapor. Pipe 10 is provided with a bottom end cap 12 to suitably seal to the pipe and also provide a gas impervious seal. Obviously, the bottom of the tube or pipe can be integrally formed during the formation of the pipe. However, the simplest and least expensive method of manufacture is to provide a single continuous length of pipe and to utilize an end cap such as cap 12. Pipe 10 is partially filled with a major volume of a heat transfer medium 14. In the preferred embodiment of the present invention, the heat transfer medium is calcium chloride hexahydrate, which is in liquid form at about 85° F. As indicated, the filling of pipe 10 is only partial so as to provide a void space 16 above the heat transfer medium 14 for the expansion and contraction of the heat transfer medium during use of the heat pipe. After disposing a predetermined amount of heat transfer medium 14 in pipe 10 in accordance with conventional practice, the top of the heat pipe is then closed and sealed by means of end cap 18. The attachment and sealing of caps 12 and 18 is carried out in the preferred instance by welding. The welding of plastic pipe is a well-known technique familiar to those skilled in the art, particularly in the construction of fluid transmission lines utilizing synthetic resins, such as polypropylene and polyethylene. The filling and sealing in the example illustrated usually takes place at about 85° F. and the relative volumes of heat transfer medium and void space within the heat pipe at the time of closing and sealing is generally as illustrated in FIG. 1.

FIG. 2 of the drawings shows the conventionally filled and sealed heat pipe after the sealing and cooling thereof. In the instance shown, the heat pipe has cooled to a temperature of about 75° F., usually atmospheric temperature, at which temperature the sodium chloride hexahydrate is solid. It is to be observed that, as a result of the phase transition of the heat transfer medium 14, the void space 16 above the heat transfer medium has substantially enlarged by the amount shown by the change in volume $\Delta V$. As a result, a partial vacuum is created in the void space 16. It has been found, in accordance with the present invention, that this partial vacuum can cause flexural fatigue failure of the pipe 10, thereby resulting in the ingress and egress of gases and vapors and the essential destruction of the device for its intended purposes.

As previously indicated, it has been conventional practice in such cases to pressurize the heat pipe with sufficient inert gas to provide a positive internal pressure higher than the external pressure to which the heat pipe is subjected at the lowest temperature to which the device is to be subjected. Such pressurization is carried out, as previously indicated, after closure and sealing of the heat pipe and requires specialized equipment and techniques which are costly and time consuming.

FIG. 3 of the drawings illustrates the improved heat pipe of the present invention at the time of closure and sealing. As illustrated, heat pipe 10 is partially filled with heat transfer medium 14 in a conventional manner. Thereafter, a minor quantity of a pressurizing material, such as a cube of dry ice (solidified $CO_2$) 20 is disposed in the heat pipe. As shown in FIG. 4, the dry ice evaporates and creates a positive pressure in the void space 16. Other liquid or solid pressurizing materials, which undergo phase transition to a gaseous state at a temperature at least as high as about the lowest temperature to which the device is subjected can be utilized. The amount of pressurizing material is sufficient to create a positive pressure in void space 16 just above the highest pressure to which the outside of the container is subjected, usually atmospheric.

The present method of pressurizng the heat transfer device also permits the use of any one of a wide variety of sealing techniques, particularly economical methods. For example, rather than utilizing end caps as illustrated, the end caps may be eliminated and the tube crimped and sealed by heat fusion welding. The crimped seal may have the form of a straight seam, a cross seam, a straight crimp with an overlapping flap (see U.S. Pat. No. 3,968,000), etc.

As previously indicated, variations and modifications of the present invention will be apparent to one skilled in the art and accordingly, the invention is to be limited only in accordance with the appended claims.

I claim:

1. A heat transfer device comprising:

(a) a gas impervious, elongated container sealed against the ingress or egress of vapors or gases;

(b) a major portion of a heat transfer medium which evaporates and condenses within the temperature range at which said device is to be utilized, partially filling said container at the highest temperature to which the device is to be subjected, thereby forming a void space therein; and a minor amount of a solidifiable or liquifiable normally gaseous pressurization medium adapted to undergo phase transition and which is gaseous at a temperature at least as high as about the lowest temperature to which said device is subjected, in an amount sufficient to create a positive pressure in said void space at said at least said lowest temperature to which said device is to be subjected.

2. A device in accordance with claim 1 wherein the container is made of a thermoplastic resin.

3. A device in accordance with claim 2 wherein the thermoplastic resin is polyethylene.

4. A device in accordance with claim 2 wherein the thermoplastic resin is polypropylene.

5. A device in accordance with claim 2, 3 or 4 wherein the container is sealed by heat fusion welding.

6. A device in accordance with claim 1 wherein the heat transfer medium is calcium chloride hexahydrate.

7. A device in accordance with claim 1 wherein the pressurizing material is a solidifiable, normally gaseous material.

8. A device in accordance with claim 7 wherein the pressurizing material is a solidifiable, normally gaseous inert gas.

9. A device in accordance with claim 8 wherein the pressurizing material is carbon dioxide.

10. A method of manufacturing a heat transfer device comprising:

(a) disposing in a single, gas impervious container a major volume of a solid or liquid heat transfer medium which evaporates and condenses over the working temperature range of the device, in an amount sufficient to partially fill said container and leave a void space therein at the highest temperature to which said device is to be subjected;

(b) adding to said container an inert, solidifiable or liquifiable pressurizing material, which undergoes phase transition to a gaseous state at a temperature at least as high as the lowest temperature to which said device is to be subjected, as a solid or a liquid and in a minor amount sufficient to create a positive pressure within said void space at said lowest temperature to which said device is to be subjected; and (c) sealing said container to produce a gas and vapor impervious device.

11. A method in accordance with claim 10 wherein said container is a thermoplastic resin.

12. A method in accordance with claim 11 wherein the thermoplastic resin is polyethylene.

13. A method in accordance with claim 11 wherein the thermoplastic resin is polypropylene.

14. A method in accordance with claim 11, 12 or 13 wherein the container is sealed by heat fusion welding.

15. A method in accordance with claim 10 wherein the heat transfer medium is calcium chloride hexahydrate.

16. A method in accordance with claim 10 wherein the pressurizing medium is a solidifiable material.

17. A method in accordance with claim 16 wherein the solidifiable material is carbon dioxide.

18. A method in accordance with claim 10 wherein the lowest temperature to which said device is to be subjected is atmospheric temperature.

* * * * *